US005899032A

United States Patent [19]

Buzby

[11] Patent Number: 5,899,032

[45] Date of Patent: May 4, 1999

[54] STAIR STRUCTURE

[76] Inventor: Edward Buzby, P.O. Box 140016, Salena, Ak. 99714

[21] Appl. No.: 08/970,218

[22] Filed: Nov. 14, 1997

[51] Int. Cl.[6] ..... E06C 7/50

[52] U.S. Cl. ..... 52/182; 52/188; 52/191; 52/715

[58] Field of Search ..... 52/182, 188, 191, 52/715

[56] References Cited

U.S. PATENT DOCUMENTS

| | | | |
|---|---|---|---|
| 829,107 | 8/1906 | Grossman | 52/188 |
| 888,882 | 5/1908 | Grossman | 52/188 |
| 1,069,596 | 8/1913 | Baldry | 52/188 |
| 4,422,270 | 12/1983 | Lapointe et al. | 52/182 |
| 4,819,391 | 4/1989 | Tassin et al. | 52/182 |
| 4,866,894 | 9/1989 | Brown | 52/191 X |
| 5,293,722 | 3/1994 | Reimann | 52/182 |
| 5,636,483 | 6/1997 | Wille | 52/188 |
| 5,791,101 | 8/1998 | Wallace | 52/182 X |

FOREIGN PATENT DOCUMENTS

| | | | |
|---|---|---|---|
| 2225357 | 5/1990 | United Kingdom | 52/188 |

*Primary Examiner*—Chrisopher Kent
*Assistant Examiner*—Timothy B. Kang
*Attorney, Agent, or Firm*—Michael J. Davella

[57] ABSTRACT

A stair system that uses angled brackets to form risers. The brackets are attached to wooden or metal boards. These boards are standard dimensional lumber. The ends of the boards must be cut to position them to support the stair, but no other cutting is required. The angled brackets have an upper section, and a lower leg portion that extends at a right angle to the upper portion. Both the upper and lower portions have flanges on them. The flanges support a tread. The treads fit over the brackets to form the actual stair. The treads are designed to receive carpeting to match the desired decor of the building in which the stair is placed. The treads are also designed to permit a mixed wood and carpet design. Wood flooring may also be used by placing the wood directly onto the brackets.

18 Claims, 5 Drawing Sheets

STAIR STRUCTURE

This invention relates to staircases and particularly to staircases having pre-formed support structures.

BACKGROUND OF THE INVENTION

Staircases have existed almost since the beginning of time. Many types of materials have been used in making stairs. In most residential construction, stairs are built from lumber. A typical staircase has two main parts: the risers and the treads. The risers are boards that are cut in a notch pattern, at some angle, to form the base of the stairs. Usually two or three risers are needed to form a staircase. The treads are boards cut to fit across the risers. The treads are attached to the risers by placing them into the notches on the risers. When the risers are set at the proper angle, the treads lie flat in an ascending or descending pattern. The process of cutting the riser boards is one of the skills that every carpenter must learn. This process involves calculating the number of treads needed for a given space, the size of the treads, and the length of span to be covered. A framing square is often used to lay out the placement of the notches on the riser boards. Once the series of notches has been marked, the boards can be cut.

Despite the availability of tools that make this layout and cutting easier, it is still a time consuming and error prone operation. One mistake in layout or cutting results in wasted wood and time. Several attempts at reducing the potential for error have been developed. These typically take the form of pre-measured and pre-formed stair assemblies.

Examples of the pre-measured stair assemblies can be found in U.S. Pat. Nos. 960,412, 1,701,659, 1,166,428, 2,377,994 and 5,357,724. These designs use a pre-made stair tread and some type of pre-formed supporting structure. These systems completely remove any guess work or field cutting to form the stairs. Most of these systems use metal to form the stair structures.

A second type of system has also been developed. In this system, parts are field assembled to make a stair. Examples of these stairs are found in the following patents. U.S. Pat. No. 3,978,628 shows a pre-formed tread and riser in one piece. Each piece has a set of tabs and slots that interlock with other pieces. In this way, several of these units can be connected to form a stair. U.S. Pat. No. 4,422,270 teaches use of angle brackets. These brackets are arrayed in pairs that are bolted together. A separate tread is then bolted to the top of the brackets. This assembly can then be bolted to the building framing to make a completed stair. U.S. Pat. No. 4,593,503 uses a pair of scissors linkages to form the risers for the stair. These linkages can be set at any desired angle and are then bolted to the framing for support. The linkages have flanges that hold the treads, which can be made of wood or other materials. Finally, U.S. Pat. No. 4,951,434 teaches use of a set of angled riser supports and a set of pre-formed stairs. Each stair has a tread and the body of a riser formed into one piece. Each stair bolts to the riser supports to form the staircase.

Although all of these designs have some benefits, they also have inherent problems. In most cases, the pre-formed stairs are sized at the factory. There is no easy way to adjust them in the field. This means the staircase must be designed to accommodate the fixed sizes of the components. In other cases, special framing is required to support the assemblies. This reduces the benefits of such stairs as material and labor are need for the framing. Also, many of the bolt-together stairs shown require a substantial number of bolts, which slows down the assembly time.

BRIEF SUMMARY OF THE INVENTION

The instant invention overcomes these problems. It consists of three basic parts. The first is a set of tread supports. These are angled brackets. The brackets attach to the second part of the system: wooden risers. These risers are standard dimensional lumber. The ends of the risers are cut to position them to support the stair, but no other cutting is required. The third component is the tread members.

The angled brackets have an upper section and a lower leg portion that extends at a right angle to the upper portion. Both the upper and lower portions have flanges on them. The flanges support the tread members. The treads fit over the tread supports and form the actual stair. The treads are designed to receive carpeting to match the desired decor of the building in which the stair is placed. The treads are also designed to permit a mixed wood and carpet design, if that is desired. As an alternative, wood flooring boards can be attached directly to the tread supports to form a set of wooden treads.

In practice, the tread supports are positioned on a pair of risers to form the stair pattern. The supports are designed so that the lower leg of the upper support fits against the upper portion of the lower support, as the supports extend up the staircase. The lower leg portions are marked with rule markings so that the exact spacing can be set by aligning the specified rule marking with the upper edge of the upper portion. Once set, the supports can be fastened to the riser using screws or similar fasteners. Once the tread supports are fastened to the risers, the treads can be attached to the tread supports. Then the desired finishing material can be added to complete the job.

The advantages of this system are several. It is easy to install and requires no complicated measuring or cutting. It is fully adaptable to any stair height desired, and it can receive any finish desired, making the stair fully compatible with the rest of the building's decor.

DETAILED DESCRIPTION OF THE INVENTION

Figure 1:
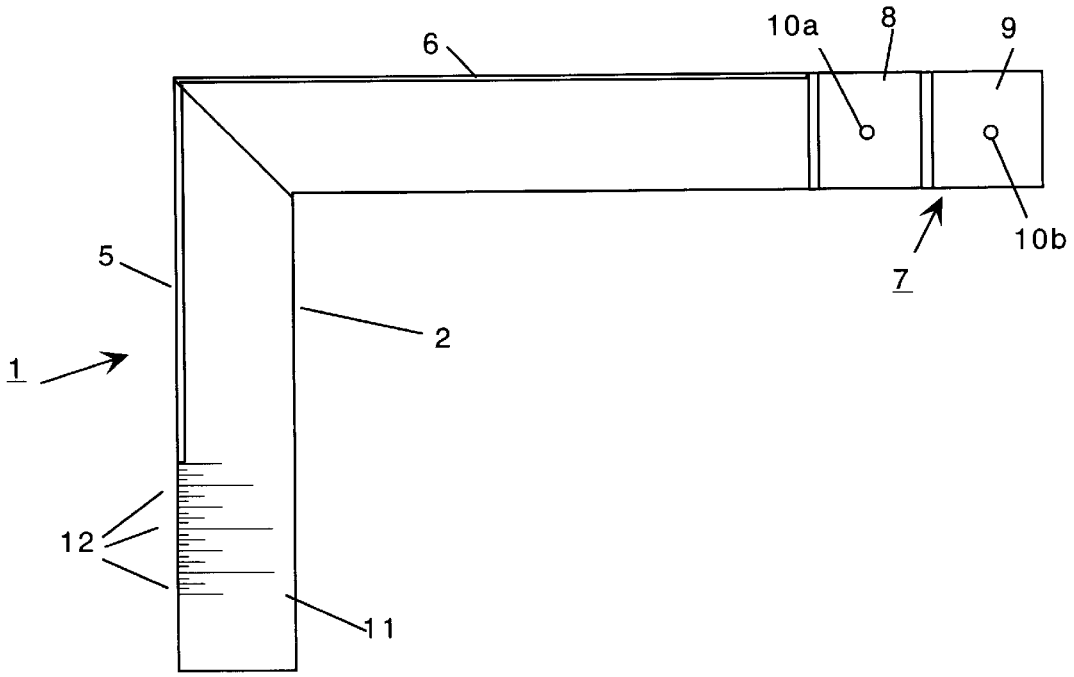
FIG. 1 is a side view of a tread support member of the preferred embodiment.
Figure 2:
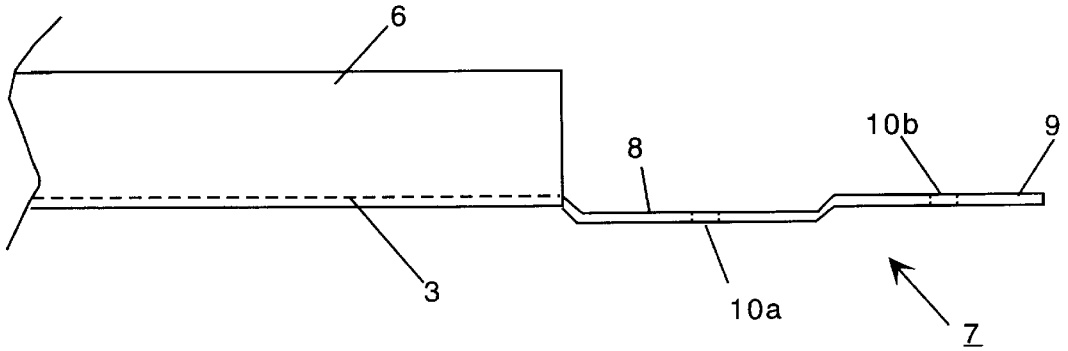
FIG. 2 is a top view of a tread support of the preferred embodiment.

Referring now to FIG. 1, a tread support 1 of the preferred embodiment is shown. The tread support 1 has an upper portion 3 and a lower leg portion 2. The lower leg portion 2 extends down from the upper portion 3 at a right angle. The upper portion 3 has a flange 6 that extends outwardly as shown (see also FIG. 2). The lower leg portion 2 also has a flange 5 that extends into the same plane as that of the upper flange 6. These flanges 5 and 6 are used to hold a tread 15 in place (the treads 15 are discussed in more detail below). The flanges 5 and 6 do not extend completely to the ends of the upper and lower portions. The end 7 of the upper portion 3 has a flared portion 8 (see also FIG. 2), and a flat arm 9. Both the flared portion 8 and the flat arm 9 have mounting holes 10*a* and 10*b*, respectively, drilled in them. The use of these holes is discussed below.

Figure 6:
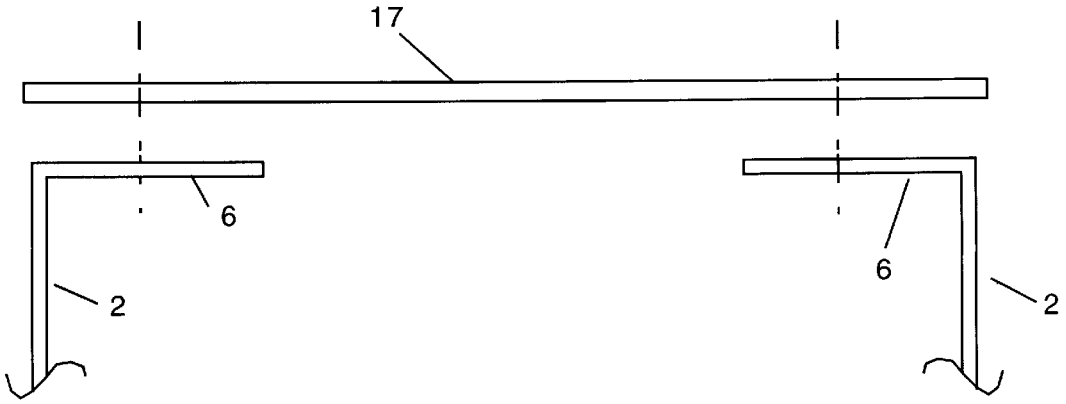
FIG. 6 is a partial front view of a pair of tread supports aligned to receive a tread member.
Figure 7:
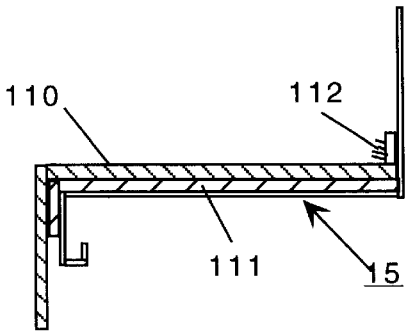
FIG. 7 is a side view of a tread member showing placement of carpeting on the tread.
Figure 8:
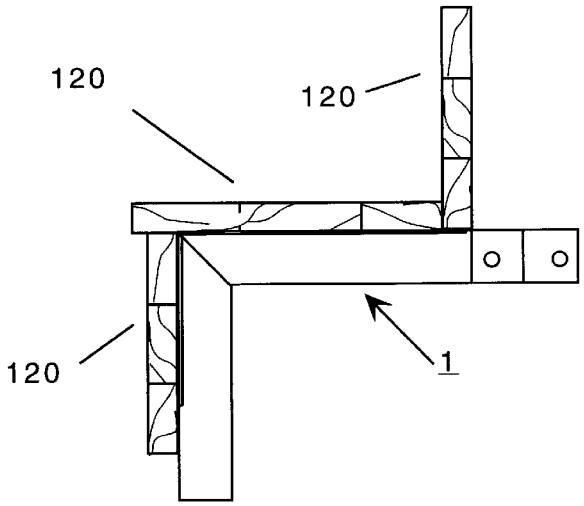
FIG. 8 is a side view of a tread showing placement of wood boards placed on the tread support member.

The end 11 of the lower portion 2 is completely flat. This end 11 has marked with rule markings 12, in any unit or scale desired. To make a complete stair, two complementary tread support members 1 are needed. These pairs are mirror images of each other, as discussed below, and as shown in FIG. 6.

Figure 3:
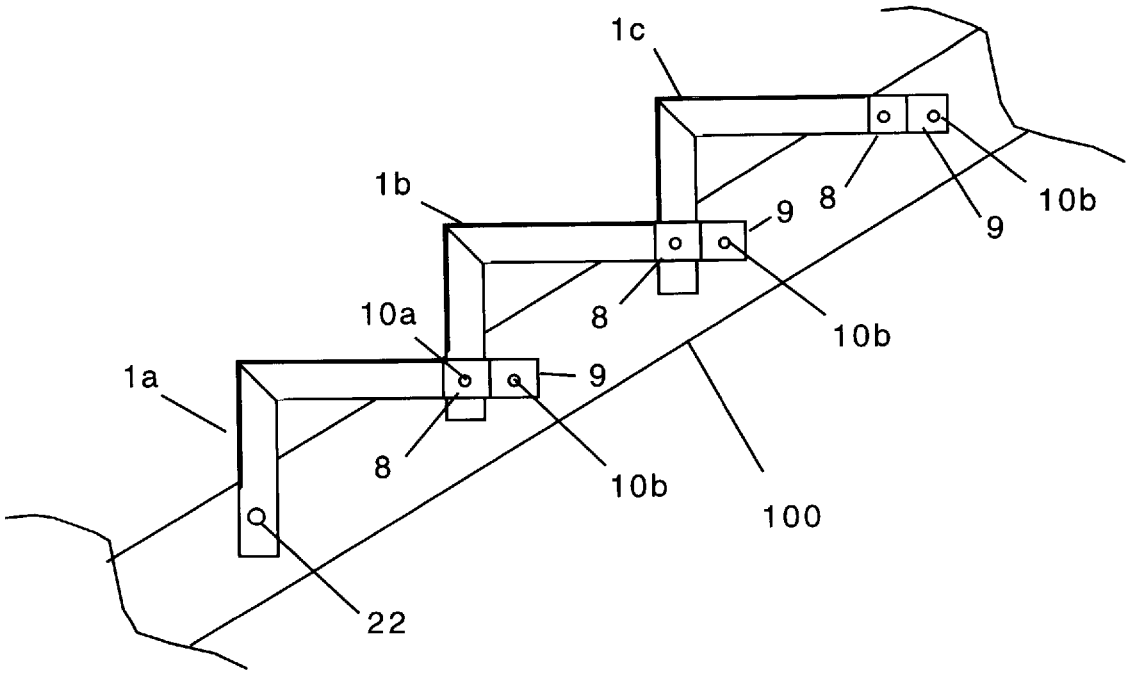
FIG. 3 is a side view of a set of tread supports of the preferred embodiment, attached to a riser.

FIG. 3 shows the assembly of a stair using the tread supports 1 and a riser 100. The riser 100 is made of dimensional lumber, such as a 2×4 or 2×6 board, or can be a metal stud or other member. To make a stair, the lowest tread support (in FIG. 3, designated as 1*a*) is placed on the riser. A holding screw is placed in hole 10*b* on the flat arm 9 of the upper portion 7. This screw holds the support 1*a* in place while allowing it to be adjusted as needed.

The next step is to insert the lower portion 11 of the next highest support, 1*b*, into the flared portion 8 of the first support 1*a*. Use of the flared portion allows the lower portion 11 of support 1*b* to lie flat against the riser 100 and provides lateral support and stability for the tread support. The lower unit 11 is slid down until the proper marking 12 has been aligned with the lower tread support 1*a*. At this point, a screw can be placed into the hole 10*b* of the second tread support 1*b*. This then is repeated for the support 1*c* as shown. By adding treads supports as described above, the entire stair can be quickly laid out and positioned. Once all the supports are in place, any final adjustments can be made before the supports are fastened to the riser through the holes 10*a* in the flared portions 8 of the supports 1. Driving a screw through hole 10*a* secures both supports to the riser. Note that a screw 22 is used to attach the lowest support 1*a* through the lower portion 11 of 1*a* as shown. No pre-drilled hole is provided here, however.

Once both sets of tread supports are attached to the risers 100 the risers can be placed onto the building framing to form the risers for the staircase. This procedure is the same as that used in conventional staircases.

Figure 4:
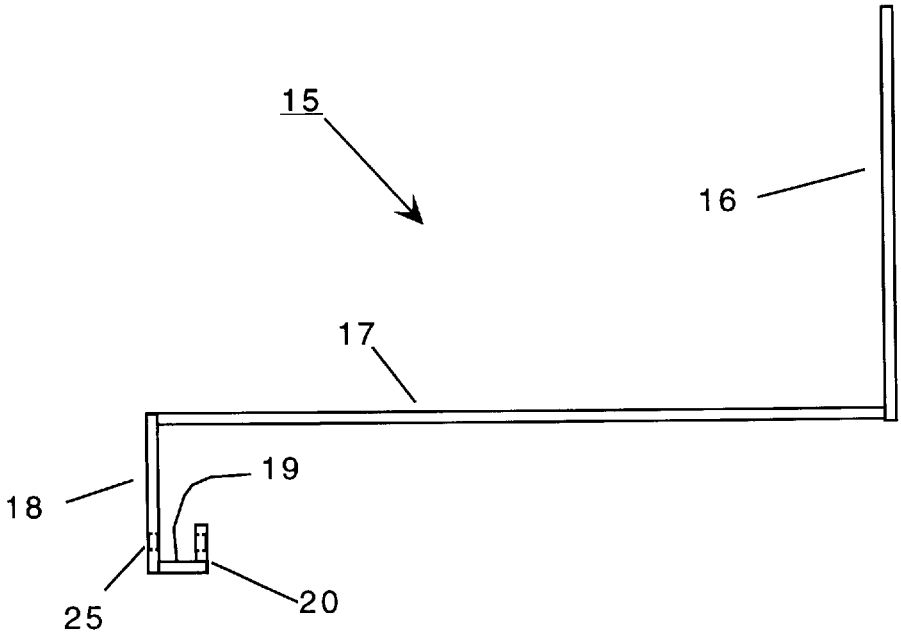
FIG. 4 is a side view of a tread member.
Figure 5:
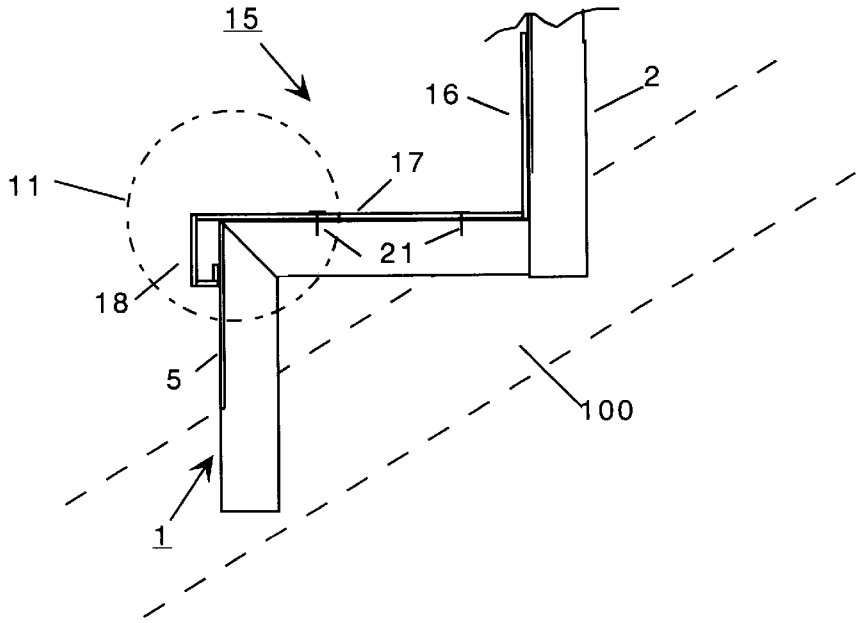
FIG. 5 is a side view of a tread member in place on a tread support of the second embodiment, with a riser shown for reference.

Once both risers are positioned, the treads 15 can be installed. The treads are shown in FIGS. 4–9. As shown in FIG. 4, the treads 15 have a vertical member 16, a horizontal member 17 and a front flange 18. The front flange 18 has a lower lip 19 and a back support 20 as shown. Holes 25 are provided for a screw to secure the tread as discussed below. FIGS. 5 and 6 show how the tread 15 fits onto the tread support 1. The front flange 18 fits against the flange 5 of the lower portion 2 of the tread support 1 as shown. The horizontal member 17 rests against the flange 6 of the upper portion 3 of the tread support 1. See, e.g., FIG. 6. The vertical member 16 then rests against the flange 5 of the lower portion 2 of the next higher tread support 1 as shown in FIG. 5. The vertical flange 16 is designed to fit up against the lower lip 19 of the front flange 18 of the next higher tread. All the treads 15 are attached to the tread supports 1 using screws 21 or other suitable fasteners. See also FIG. 11. FIG. 6 shows the arrangement of complementary pairs of tread supports.

When the treads 15 are installed, they completely fill the space between the risers 100. This makes a solid stair. When covered with carpet and pad, for example, this stair tread looks like a wooden stair that has been covered with carpet. To cover the stair, carpet 110 and pad 111 and tack strip 112 are attached to the tread 15 using techniques common to that art. See, FIG. 7.

Figure 9:
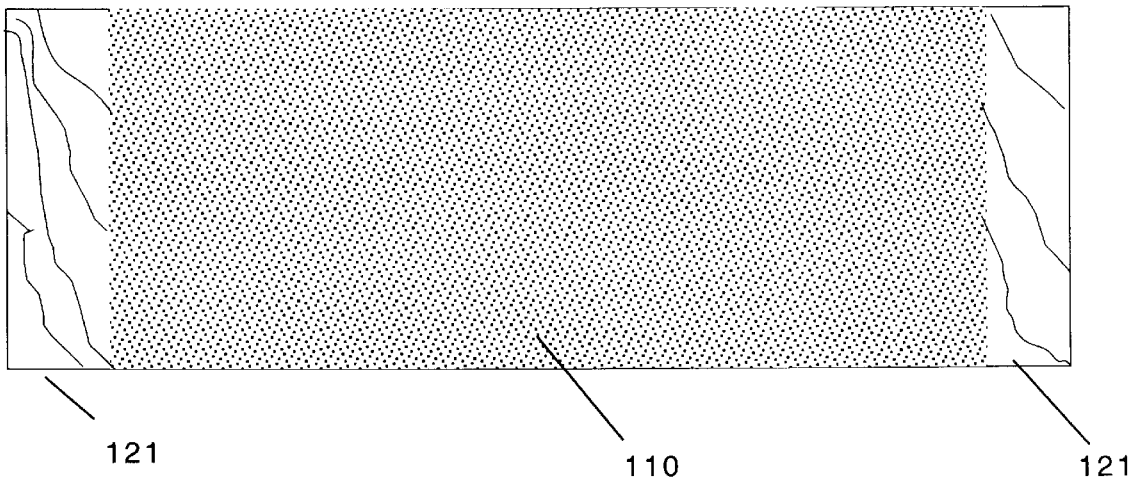
FIG. 9 is a top view of a tread showing a combination of wood and carpet in place on the tread member.

It is also possible to cut and place flooring boards 120 to fit over the treads supports, to give the stairs a natural wood finish look. See, FIG. 8. It is also possible, as shown in FIG. 9, to place carpet 110 in the center of the stair tread 15 and to place wood trim 121 around the edges of the tread 15. This presents a high quality finish that has the look of a wooden stair that is covered with carpet. Here, the wood trim 121 must be cut to match the height of the carpet 110 and pad. The wood can be covered with veneer strips to hide the end grain, if desired.

The tread supports 1 and treads 15 are fashioned from steel or other suitable materials. The treads 15 are designed to be thin so that the finish treatment can be applied without having too bulky an appearance.

Figure 10:
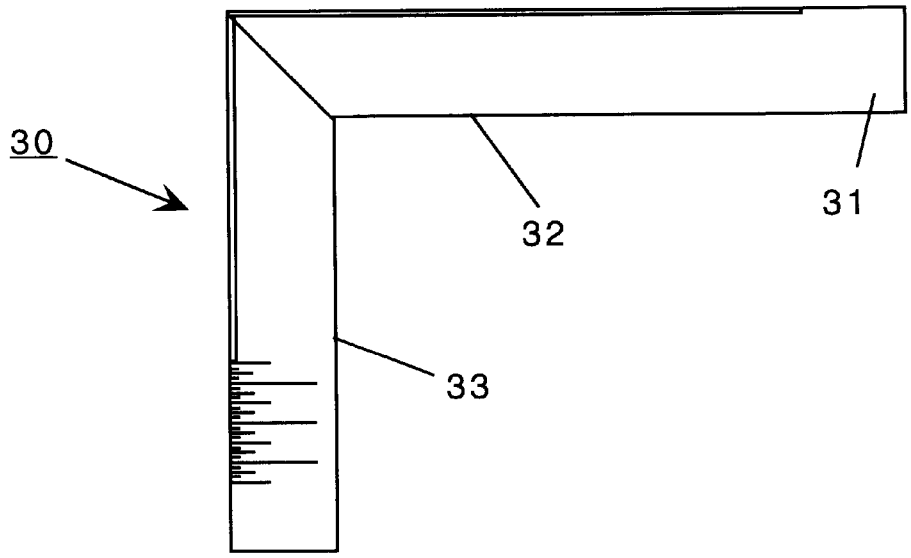
FIG. 10 is a side view of a tread support of the second embodiment.

FIG. 10 shows a second embodiment of the tread support 30. In this embodiment, the portion 8 is omitted. The end 31 of the upper portion 32 is completely flat. The flat lower leg portion 33 of the next tread support lies against this flat portion 31. This is not preferred, however, because the overlap of the flat portions causes bending. Also, the lack of the protrusions hampers quick alignment of the tread supports.

Figure 11:
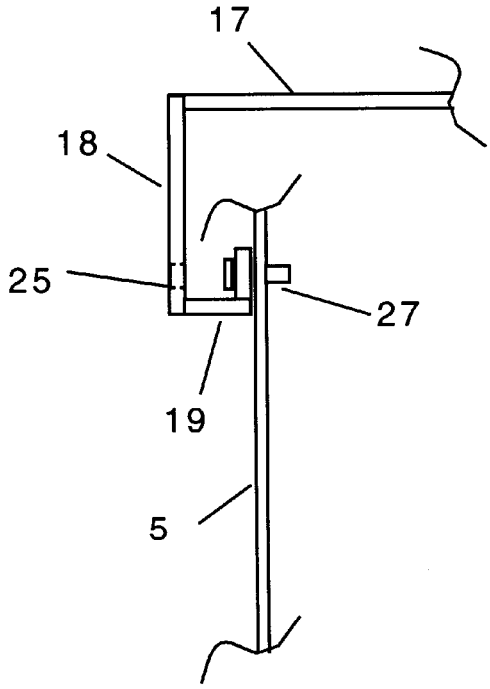
FIG. 11 is a detail view of a tread support and a tread member showing a screw attachment of the tread member to the tread support.

Finally, FIG. 11 shows a detail for attaching the tread 15 to a tread support 1 by placing a screw 27 through the holes 25 as shown. The recessed holes 25 keep the screw 27 from interfering with the carpet 110 when it installed.

The present disclosure should not be construed in any limited sense other than that limited by the scope of the claims having regard to the teachings herein and the prior art being apparent with the preferred form of the invention disclosed herein and which reveals details of structure of a preferred form necessary for a better understanding of the invention and may be subject to change by skilled persons within the scope of the invention without departing from the concept thereof.

I claim:

1. A stair system comprising:

a) a plurality of riser members, being positioned in a parallel configuration;

b) a plurality of tread support members, said plurality of tread support members, being attached to each riser member, said plurality of tread support members each including a lower bracket member and an upper bracket member being perpendicular to said lower bracket member, said lower bracket member having a length and a lower bracket flange portion extending along a portion of the length of said lower bracket member, said lower bracket flange portion extending outward from said lower bracket member, and further wherein said upper bracket member has a length, and an upper bracket flange portion extending along a portion of the length of said upper bracket member, said upper bracket flange portion extending outward from said upper bracket member, and further wherein said upper bracket member includes an articulated portion and a flat portion;

c) a means for attaching said plurality of tread support members to said plurality of risers;

d) a plurality of tread members; and e) a means for attaching said plurality of tread members to said plurality of tread support members, thereby forming a staircase.

2. The stair system of claim 1 wherein said plurality of tread members are made of metal.

3. The stair system of claim 1 wherein said plurality of tread members is made of wood.

4. The stair system of claim 1 wherein said plurality of tread members is covered with carpet.

5. The stair system of claim 1 wherein said plurality of tread members each include an upper flange portion, a horizontal tread portion, extending perpendicularly from said upper flange portion, and a front flange portion extending downwardly from said horizontal tread portion.

6. The stair system of claim 1 wherein the plurality of tread members is covered with a combination of carpet and wood pieces.

7. The stair system of claim 1 wherein said plurality of risers are made of wood.

8. The stair system of claim 1 wherein said plurality of risers are made of metal.

9. A stair system comprising:

a) a plurality of riser members, being positioned in a parallel configuration;

b) a plurality of tread support members, said plurality of tread support members, being attached to each riser member, said plurality of tread support members each including a lower bracket member and an upper bracket member being perpendicular to said lower bracket member, said lower bracket member having a length and a lower bracket flange portion extending along a portion of the length of said lower bracket member, said lower bracket flange portion extending outward from said lower bracket member, and further wherein said upper bracket member has a length, and an upper bracket flange portion extending along a portion of the length of said upper bracket member, said upper bracket flange portion extending outward from said upper bracket member, and further wherein said upper bracket flange portion also includes a connection flange extending rearwardly from said upper bracket member and further wherein said connection flange of said upper bracket member includes an articulated portion and a flat portion;

c) a means for attaching said plurality of tread support members to said plurality of risers;

d) a plurality of tread members; and e) a means for attaching said plurality of tread members to said plurality of tread support members, thereby forming a staircase.

10. The stair system of claim 9 wherein said articulated portion and said flat portions each include a mounting hole therein.

11. The stair system of claim 9 wherein said plurality of tread support members are attached to said plurality of risers such that the lower bracket member of one tread support member is placed within the articulated portion of an adjacent lower level tread support member.

12. The stair system of claim 9 wherein said plurality of tread members are made of metal.

13. The stair system of claim 9 wherein said plurality of tread members is made of wood.

14. The stair system of claim 9 wherein said plurality of tread members is covered with carpet.

15. The stair system of claim 9 wherein said plurality of tread members each include an upper flange portion, a horizontal tread portion, extending perpendicularly from said upper flange portion, and a front flange portion extending downwardly from said horizontal tread portion.

16. The stair system of claim 9 wherein the plurality of tread members is covered with a combination of carpet and wood pieces.

17. The stair system of claim 9 wherein said plurality of risers are made of wood.

18. The stair system of claim 9 wherein said plurality of risers are made of metal.

* * * * *